US009085938B2

(12) United States Patent
Panchal et al.

(10) Patent No.: US 9,085,938 B2
(45) Date of Patent: Jul. 21, 2015

(54) MINIMUM STRAIN ENERGY WAYPOINT-FOLLOWING CONTROLLER FOR DIRECTIONAL DRILLING USING OPTIMIZED GEOMETRIC HERMITE CURVES

(75) Inventors: Neilkunal Panchal, London (GB); Martin Bayliss, Stroud (GB); James Whidborne, Milton Keynes (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 822 days.

(21) Appl. No.: 13/222,983

(22) Filed: Aug. 31, 2011

(65) Prior Publication Data

US 2013/0048383 A1 Feb. 28, 2013

(51) Int. Cl.
*E21B 7/04* (2006.01)
*E21B 44/00* (2006.01)

(52) U.S. Cl.
CPC .. *E21B 7/04* (2013.01); *E21B 44/00* (2013.01)

(58) Field of Classification Search
CPC ..... E21B 44/00; E21B 7/04; E21B 7/06; E21B 47/00; E21B 7/046; E21B 44/02; E21B 47/01; G01V 11/00
USPC ..... 175/61, 73, 45, 26; 702/9
See application file for complete search history.

(56) References Cited

U.S. PATENT DOCUMENTS

| | | | | |
|---|---|---|---|---|
| 5,220,963 | A * | 6/1993 | Patton | 175/24 |
| 5,390,748 | A | 2/1995 | Goldman | |
| 2009/0090555 | A1* | 4/2009 | Boone et al. | 175/45 |
| 2011/0112802 | A1 | 5/2011 | Wilson et al. | |

FOREIGN PATENT DOCUMENTS

| | | |
|---|---|---|
| RU | 2157445 | 10/2000 |
| RU | 2187637 | 8/2002 |

OTHER PUBLICATIONS

International Search Report for the equivalent PCT patent application No. PCT/US12/49949 issued on Nov. 29, 2012.

J.-H. Yong and F. Cheng, "Geometric Hermite curves with minimum strain energy," Computer Aided Geometric Design, vol. 21, pp. 281-301, 2003.

Y. Guo and E. Feng, "Nonlinear dynamical systems of trajectory design for 3D horizontal well and their optimal controls," Journal of Computational and Applied Mathematics, vol. 212, pp. 179-186, 2008.

Z. Gong and C. Liu, "Optimization for multiobjective optimal control problem and its application in 3D horizontal wells," in Proc. of the 6th World Congress on Intelligent Control and Automation, Dalian, China, Jun. 2006.

(Continued)

*Primary Examiner* — Shane Bomar
*Assistant Examiner* — Wei Wang
(74) *Attorney, Agent, or Firm* — Chadwick A. Sullivan; Wesley Noah

(57) ABSTRACT

A method and apparatus for controlling drilling, the method comprising ascertaining a current position and attitude of a drilling structure, obtaining a desired end point for the drilling structure, creating an optimized geometric Hermite curve path for the drilling structure from the current position and attitude of the drilling structure to the desired end point for the drilling structure and controlling a drilling of the drilling structure from the current position and attitude of the drilling structure to the desired end point for the drilling structure along the optimized geometric Hermite curve path.

10 Claims, 6 Drawing Sheets

(56) References Cited

OTHER PUBLICATIONS

R. T. Farouki, J. Manjunathaiah, D. Nicholas, G. F. Yuan, and S. Jee, "Variable feedrate CNC interpolators for constant material removal rates along Pythagorean-hodograph curves," Comput. Aided Design, vol. 30, pp. 631-640, 1998.

N. Panchal, M. T. Bayliss, and J. F. Whidborne, "Robust linear feedback control of attitude for directional drilling tools," in Proc. 13th IFAC Symposium on Automation in Mining, Mineral and Metal Processing, Cape Town, Aug. 2010.

J. Matheus and S. Naganathan, "Drilling automation: Novel trajectory control algorithms for RSS," in IADC/SPE Drilling Conference and Exhibition, New Orleans, LA, 2010.

R. T. Farouki, "Pythagorean-Hodograph Curves," Berlin: Springer-Verlag, 2008.

D. Pirovolou, C. D. Chapman, M. Chau, H. Arismendi, M. Ahorukom-eye, and J. Penaranda, "Drilling automation: An automatic trajectory control system," in Proc. SPE Digital Energy Conference and Exhibi-tion, No. 143899-MS, The Woodlands, TX, Apr. 2011.

* cited by examiner

MINIMUM STRAIN ENERGY WAYPOINT-FOLLOWING CONTROLLER FOR DIRECTIONAL DRILLING USING OPTIMIZED GEOMETRIC HERMITE CURVES

FIELD OF THE INVENTION

The present disclosure relates to directional drilling. More specifically, aspects of the disclosure relate to providing a minimum strain energy waypoint following controller arrangement and method for directional drilling applications.

BACKGROUND INFORMATION

As the future of directional drilling moves toward the exploitation of increasingly complex reservoirs, there is a desire and a need for automating rig operations as much as possible. The implications and advantages of such automated rig operations would enable rig operation teams to focus on higher levels of decision making, hence increasing safety and economic return.

Current drilling controllers, for example, have significant drawbacks that include inaccurate controlling capability and inability to minimize strain energy on drilling components. In addition to these drawbacks, conventional systems require constant maintenance and attention by personnel. There is a need to provide a drilling controller to solve these issues and to provide a superior controlling methodology and apparatus compared to conventional controllers.

DETAILED DESCRIPTION

Aspects described present, in one non-limiting embodiment, the application of Optimized Geometric Hermite ("OGH") curves as a method for real-time path planning and following for directional drilling tools which have the ability to hold inclination and azimuth. In the embodiments presented, different drilling apparatus may be controlled, such as a drill string or coiled tubing drilling, as non-limiting embodiments. In embodiments presented, the method and apparatus rely on a target position in space ahead of the drill bit with an associated target attitude. These targets, or waypoints, may be used as a sequence of points with attitudes corresponding to a well plan which is to be followed, or, in an alternative embodiment, they may be a finite number of points in space which may correspond to strategic points in a pay zone (a reservoir or portion of a reservoir that contains economically producible hydrocarbons is known as a pay or pay zone). In additional applications, this method and apparatus may be used with look-ahead, look-around geosensor technology to dynamically choose and assigned targets as an outer loop to the method presented in this patent application. In the aspects described, increases in economic payback for drilling activities is significantly enhanced solving long sought problems in the industry. Such activities described herein may be used with other drillstring control activities to provide for more autonomous control of drilling activities. Such interface may be with emergency response systems, as a non-limiting embodiment, in order to provide higher margins of safety for operators.

In one embodiment, information pertaining to a tool instantaneous position measured from the tool sensor set (gyroscopes, accelerometers, and magnetometers) is obtained and a path is determined to the next target. This path is periodically recalculated and provides a sequence of inclination and azimuth instructions which steer the tool or drillbit towards that target. Such method steps are described below in accordance with FIG. 9, as a non-limiting embodiment.

In aspects described, the use of Optimized Geometric Hermite Curves for generating the correction path from the tools instantaneous position to the well-planned trajectory is described.

Figure 1:
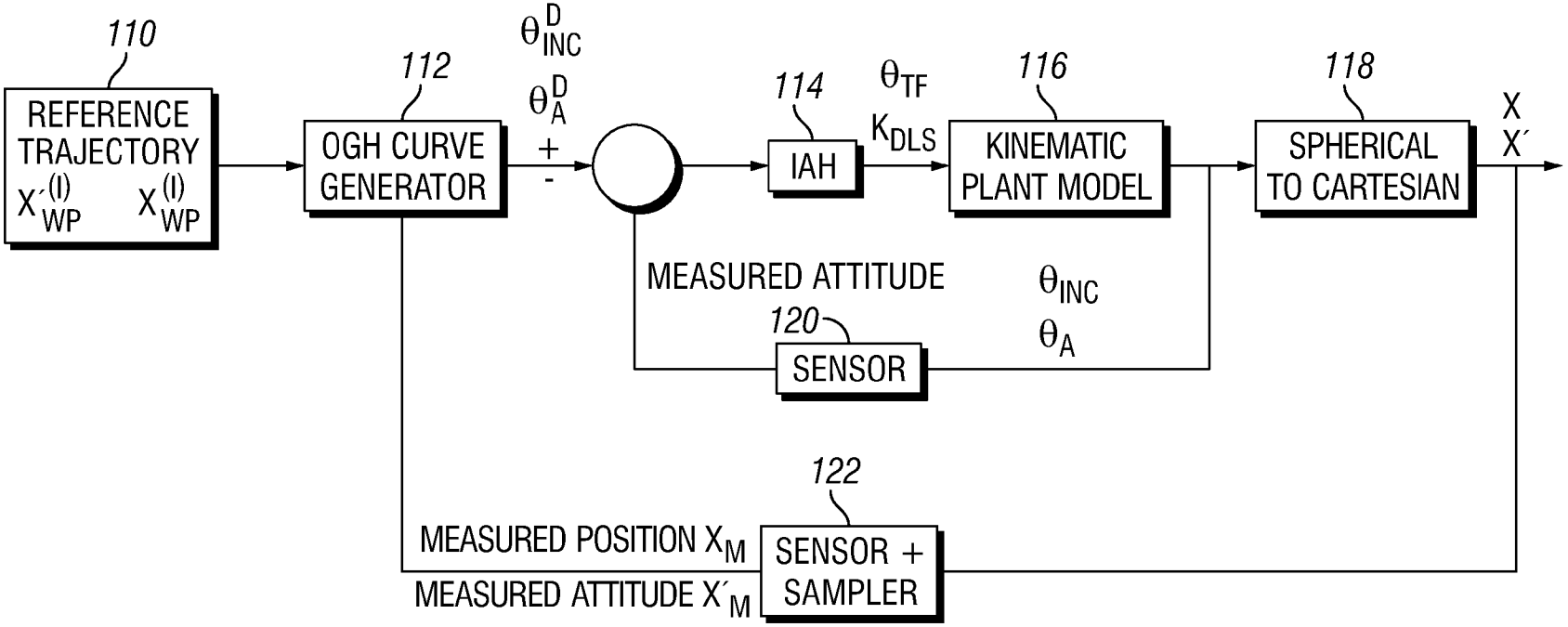
FIG. 1 is a closed-loop block diagram for a trajectory controller with two feedback loops.

The controller is first introduced, in FIG. 1, followed by summarizing the open-loop plant model including a robust analysis of attitude hold for directional drilling. The application of Optimized Geometric Hermite Curves is then described. A path following architecture is then presented which incorporates the Optimized Geometric Hermite Curve construction as the correction path, set point attitude generating outer loop, and the Inclination and Azimuth Hold ("IAH") for the attitude hold inner loop. Satisfactory algorithm operation is demonstrated by a transient simulation for a typical set of drilling operating parameters. In FIG. 1, a closed-loop construction is presented in one non-limiting embodiment.

A closed-loop scheme for following a trajectory for direction drilling operations is depicted in FIG. 1. The reference trajectory is defined by a sequence of waypoints in space $x_{wp}(i)$ which are positions which it is desired for the drill bit to penetrate through, where $1 \leq i \leq N$ is the index of a finite number of waypoints. Furthermore, the reference trajectory associated with these points have an associated attitude $x_{wp}'(i)$ for which it is desired for the tool to meet at a tangent. These waypoints can be predetermined targets from geological and seismic information, such as those obtained from downhole tools, and forthcoming waypoints may also be dynamically allocated from geosteering data. Referring to FIG. 1, a reference trajectory arrangement 110 is operably connected, at an output, to an OGH Curve generator 112. The OGH curve generator 112 is connected to an arrangement for inclination and azimuth hold (IAH) 114. The OGH curve generator 112 produces mathematically smooth results, for example with minimum strain energy as well as being geometrically smooth. A kinematic plant model 116 is connected to the IAH hold apparatus 114, as illustrated. A spherical to Cartesian coordinate converter arrangement 118 is connected a the output to the kinematic plant model 116 to allow for proper conversion of measurements to control the drilling apparatus. Two separate feedback loops are provided, wherein measured attitude is provided by a sensor 120 from the connection between the kinematic plant model 116 and the spherical to Cartesian coordinate converter arrangement 118 feeding back to the input of the inclination azimuth hold 114. Additionally, a feedback loop arrangement is provided from the output of the spherical to Cartesian coordinate converter arrangement 118 to the OGH curve generator 112 through sampler and sensor 122.

The trajectory arrangement (controller) 110 estimates a tool's current position and attitude $x_m$, $x_m'$ along with the position and attitude of the next waypoint target $x_{wp}(i)$, $x_{wp}'(i)$ and together with the OGH curve generator 112, an interpolated cubic polynomial space curve designed to produce the lowest strain energy on the drilling structure. From this interaction, a new reference demand attitude for the IAH controller is produced, which is defined as the "inner loop" and which controls the tool's direction. As will be understood, the trajectory arrangement (controller) 110, the OGH curve generator 112 and the kinematic plant model 116 as well as the converter arrangement 118 may be separate computer assemblies or the individual parts may be configured to operate as a single unit, such as a microprocessor or a computer arrangement. Each of the trajectory arrangement (controller) 110, the OGH curve generator 112 and the kinematic plant model 116 as well as the converter arrangement 118 are illustrated as being in close proximity to one another so that the entire arrangement is positioned in a field location. Alternative configurations are possible where remote processing capabilities for each of the components 110, 112, 116 and 118 are combined to control drilling activities.

The kinematic plant model 116 used to describe the changes in the direction of the drill is derived from kinematic considerations. The angular azimuth and inclination responses are given in terms of tool face and curvature inputs as:

$$\dot{\theta}_{inc} = V_{rop}(U_{dls}\cos U_{tf} - V_{dr}), \quad \text{Equation 1}$$

$$\dot{\theta}_{azi} = \frac{V_{rop}}{\sin\theta_{inc}}(U_{dls}\sin U_{tf} - V_{tr}), \quad \text{Equation 2}$$

$\dot{\theta}_{inc}$ is the inclination angle in radians,
$\dot{\theta}_{azi}$ is the azimuth angle in radians,
$U_{tf}$ is the tool face angle control input in radians,
$U_{dis}$ is the 'dog leg severity' or curvature in radians/meter,
$V_{dr}$ is the drop rate bias disturbance in radians/meter,
$V_{tr}$ is the turn rate bias disturbance in radians/meter,
$V_{rop}$ is the rate of penetration and is an uncontrolled parameter in meters/second.

Using the following transformations, the control toolface angle and steering ratio that guide the tool towards its target azimuth and inclination are found according to Equations 3 and 4.

$$U_{tf}=\arctan(U_{azi}/U_{inc}) \quad \text{Equation 3}$$

$$U_{dls}=K_{dls}\sqrt{U_{\mathrm{azi}}^2+U_{\mathrm{inc}}^2} \quad \text{Equation 4}$$

where $U_{azi}$ and $U_{inc}$ are transformed control inputs. Ignoring the distances, the plant model is transformed to:

$$\dot{\theta}_{inc} = V_{rop}(K_{dls}U_{inc}), \quad \text{Equation 5}$$

-continued $$\dot{\theta}_{azi} = \frac{V_{rop}}{\sin\theta_{inc}}(K_{dls}U_{azi}). \quad \text{Equation 6}$$

The above equations are, therefore, simpler than the model given by Equation 1 and Equation 2. The following PI controllers are defined to control the tool attitude:

$$U_{inc}=k_{pi}e_{inc}+k_{ii}\int_0^t e_{inc}dt \quad \text{Equation 7}$$

$$U_{azi}=k_{pa}e_{azi}+k_{ia}\int_0^t e_{azi}dt \quad \text{Equation 8}$$

where $e_{inc}=\theta_{inc}^d-\theta_{inc}$ and $e_{azi}=\theta_{azi}^d-\theta_{azi}$ are the inclination and azimuth errors, respectively, and $\theta_{inc}^d$ and $\theta_{azi}^d$ are the inclination and azimuth reference demands, respectively. By linearizing the transformed plant model, the PI controller gains can be chosen to provide the closed-loop system with specified closed poles.

A robustness analysis of the proposed control system provided in FIG. 1, based on the small gain theorem, was performed in order to guarantee system stability subject to measurement feedback delays, input quantization delay, and parametric uncertainty on $V_{rop}$ and $K_{dis}$.

Figure 2:
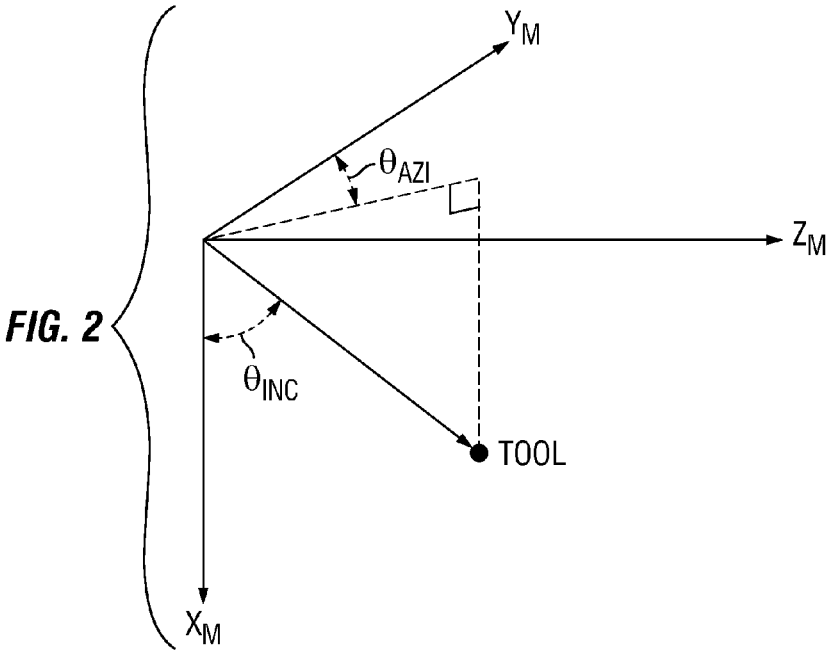
FIG. 2 is a right-handed coordinate system used to define a reference frame where an inclination angle, $\theta_{inc}$ and an azimuth angle $\theta_{azi}$ are defined.

The outer trajectory-following loop in FIG. 1 has three Cartesian position states $x_m=x_m i+y_m j+z_m k$ that are measured, either periodically or when some event occurs. Here $x_m$ is defined to be parallel to the gravitational field, and $y_m$ is in the direction of due North in the plane perpendicular to $x_m$. For this embodiment, the global coordinate system is a right-handed coordinate system with the $x_m$ axis pointing down and azimuth and inclination $\theta_{azi}$ and $\theta_{inc}$, respectively, are defined as provided in FIG. 2. The attitude as a vector in this frame is given in terms of azimuth and inclination as:

$$x_m' = \begin{pmatrix} x_m' \\ y_m' \\ z_m' \end{pmatrix} = \begin{pmatrix} \cos\theta_{inc} \\ \sin\theta_{inc}\cos\theta_{azi} \\ \sin\theta_{inc}\sin\theta_{azi} \end{pmatrix} \quad \text{Equation 9}$$

In one embodiment, autonomous drill bit on/off bottom detection is available. This capability of autonomous drill bit on/off bottom detection enables anti-windup to be implemented on the PI controllers of the IAH. Based on the surface measured depth measurement, hereinafter defined "MD", an estimate of the tool $V_{rop}$ is obtained. It is assumed that a reliable estimation of the tool position is subsequently available.

In fitting a path between the tools current position and the target, it is aimed to minimize the geometric strain energy of the interpolated spline, thereby minimizing stresses on the accompanying drilling equipment. In one embodiment, for a well, the shape of the curve has an impact on the drillstring leading up to the bottom hole assembly. Since axisymmetric cylindrical drillpipes are in an unstrained configuration prior to being used for drilling, work is done over the drilling operation by the borehole on the drillstring to bend the pipes to fit the shape. Similarly, in completing the well, a section of casing would experience the same forces.

Developing a borehole to minimize the strain energy from the tool to its target can improve fatigue life of threaded stand sections of the drillpipe. Also, reducing contact forces on the drillpipes and casing would reduce the sliding friction and would be beneficial for extended reach and increased $V_{rop}$ drilling.

Using Euler-Bernoulli beam theory, an axisymmetric beam is assumed with a constant cross-sectional area and uniform mass distribution, as a general model for the drillpipe and section of casing.

The relationship between the local curvature to the bending moment M is given by:

$$\kappa = \frac{M}{EI} \qquad \text{Equation 10}$$

where I is the second area moment and E is the module of elasticity of a section of casing or drillpipe. In one embodiment, both of these values are assumed constant.

When deflected into a space curve f(t), the work done on an element f(t+δt)−f(t) is given by ½M∂θ where t∈[0,1] parameterizes the curve f(t) from the start position to the end position, and M is the moment acting on the element dt deflecting it by an angle ∂θ where $$\theta = \frac{df}{dt}(t).$$

The curvature $\kappa$ at f(t) is given by $$\kappa = \frac{d\theta}{dt} = \frac{d^2 f}{dt^2}(t) \qquad \text{Equation 11}$$

The total strain energy over the length of the curve which is wished to minimize is given by:

$$\Phi = \frac{1}{2}EI\int_t\left[\frac{d^2 f}{dt^2}(t)\right]^2 dt = \frac{1}{2}EI\int_t \kappa^2(t)\,dt \qquad \text{Equation 12}$$

To fit a curve from the tool's current measured position to the target, a cubic spline is chosen as this is the lowest order polynomial curve that includes an inflection point, and, for fitting a feasible trajectory to a target position and attitude ahead of the bit, a smooth curve can be obtained.

Given the tool's current position $x_m$ and current attitude $x_m'$ a cubic spline is constructed to a target position $x_{wp}$ and attitude $x_{wp}'$, with respect to four Bezier control points $x_m$, $$x_m + \frac{1}{3}x_m',\ x_{wp} - \frac{1}{3}x_{wp}',$$

$x_{wp}$ where the space curve given in terms of Bernstein polynomials is:

$$f(t) = b_0 x_m + b_1\left(x_m + \frac{1}{3}x_m'\right) + b_2\left(x_{wp} - \frac{1}{3}x_{wp}'\right) + b_3 x_{wp} \qquad \text{Equation 13}$$

The cubic Bernstein polynomial coefficients are given by the relationship $$b_i = \binom{3}{i} t^i (1-t)^{(3-i)} \qquad \text{Equation 14}$$

In one embodiment, the Optimized Geometric Hermite curve is a cubic Hermite curve which as the smallest strain energy amongst all cubic Hermite curves that satisfy the endpoint conditions.

Putting the cubic Hermite curve into the form given by Equation 13, a minimal strain energy curve can be found by varying the two intermediate control points given the corresponding terms of the $b_1$ and $b_2$ Berstein coefficients. Since the start and end points, $x_m$ and $x_{wp}$ are fixed in space, the free parameters are the magnitudes of the tangent vectors $x_m'$ and $x_{wp}'$ and Equation 13 is rewritten as:

$$f(t) = b_0 x_m + b_1\left(x_m + \frac{1}{3}a_0 x_m'\right) + b_2\left(x_{wp} - \frac{1}{3}a_1 x_{wp}'\right) + b_3 x_{wp} \qquad \text{Equation 15}$$

The values for constants $a_0$ and $a_1$ that provide the Optimized Geometric Hermite Curve are found from the theorem provided below.

Given $x_m$ and $x_{wp}$ and two endpoint tangent vectors $x_m'$ and $x_{wp}'$ and Optimized Geometric Hermite Curve f(t) t∈[0,1] is obtained at $a_0 = a_0^*$ and $a_1 = a_1^*$ where $$a_0^* = \frac{6[(x_{wp} - x_m) * x_{wp}'^2 - 3[(x_{wp} - x_m) * x_{wp}'](x_m' * x_{wp}')}{4x_m^2 x_{wp}^2 - (x_m * x_{wp})^2} \qquad \text{Equation 16}$$

and $$a_1^* = \frac{3[(x_{wp} - x_m] * (x_{wp}' - x_m') - 6[(x_{wp} - x_m) * x_{wp}'](x_m'^2)}{(x_m * x_{wp})^2 - 4x_m^2 x_{wp}^2} \qquad \text{Equation 17}$$

Using the values for $a_0$ and $a_1$ from Equation 16 and 17, the Optimized Geometric Hermite Curve from Equation 15 gives a path for the tool to follow to get its target.

The scheme is implemented in a similar manner to a multipass curve scheme but with a fixed horizon rather than a receding horizon. Thus, the position is periodically measured, and the attitude reference demand for the first portion of the Optimized Geometric Hermite Curve is passed to the inner-loop IAH controller 114 shown in FIG. 1.

To allow for the lags in the IAH controller 114, the gradient of the Optimized Geometric Hermite Curve a small arbitrary fixed distance I ahead of the bit is calculated. The arc length L of the whole Optimized Gradient Hermite Curve from the tools measured position to the target is calculated numerically using:

$$L = \sum_{i=0}^{n-1}\left\|f\left(\frac{i+1}{n}\right) - f\left(\frac{i}{n}\right)\right\|_2 \qquad \text{Equation 18}$$

Where n is the number of discretization points. The attitude demand vector can be found from:

$$x_d' = \frac{df}{dt}(t = I/L). \qquad \text{Equation 19}$$

Hence the inclination $\theta_{inc}^{d}$ and azimuth $\theta_{azi}^{d}$ reference demand values for the inner IAH loop can therefore be determined from $$\theta_{inc}^{d} = \arctan\frac{[(x_d' * j)^2 + (x_d' * k)^2]^{1/2}}{x_d' * i} \quad \text{Equation 20}$$

and $$\theta_{azi}^{d} = \arctan\frac{x_d' * k}{x_d' * j} \quad \text{Equation 21}$$

and unit vectors i, j, k as defined.

The trajectory-following architecture shown in FIG. 1 incorporating OGH curves as outlined and using Equations 1 and 2 as the plant model was simulated in the time domain. The simulation parameters are shown in Table II for an idealized initially horizontal directional drill capable of steering at 15°/100 ft drilling at a constant rate of penetration of 50 ft/hr. In this simulation, the tool started at a kick-off point (KOP) with two waypoint positions with associated attitudes as displayed in Table 1.

TABLE 1

GENERAL PATH SIMULATION

| Waypoint | x (m) | y (m) | z (m) | $\theta_{inc}^{d}$ (°) | $\theta_{azi}^{d}$ (°) |
|---|---|---|---|---|---|
| KOP | 0 | 0 | 0 | 90 | 270 |
| Intermediate | 200 | 300 | −40 | 90 | 308 |
| End | 208 | 800 | −320 | 90 | 308 |

Figure 3:
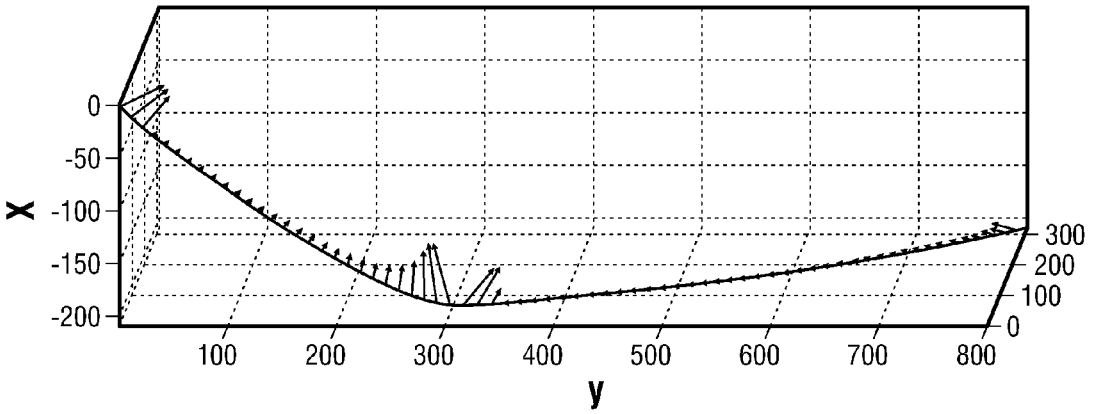
FIG. 3 is a graph of simulation results for an online path-planning trajectory controller following two waypoints.

The resulting space curve from the simulated run is shown in FIG. 3. In FIG. 3, the three triangular symbols show the waypoint positions listed in Table I. The black arrows in FIG. 3 point in the direction of the applied tool-face angle, the relative magnitude of which indicates the curvature demanded from the tool by the algorithm.

It can be seen in FIG. 3. In FIG. 6 the trajectory-following controller does make the tool converge to the waypoints as the tool propagates. Furthermore, FIG. 5 shows the attitude error magnitude of the tool computed as $$x_{error}' = \|x_m' - x_{wp}'\| \quad \text{Equation 22}$$

Where $x_m'$ is a unit vector representing the measured attitude of the drill at any instant in the simulation and $x_{wp}'$ is the attitude of the nearest target.

Figure 4:
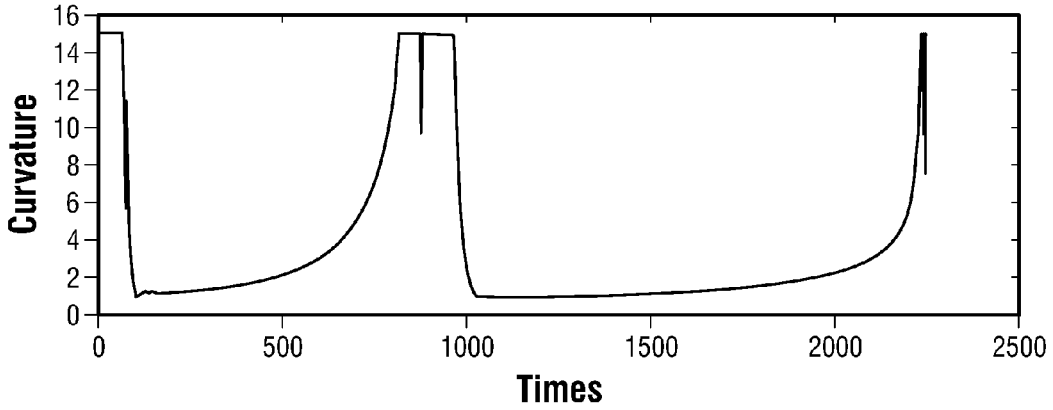
FIG. 4 is a graph of curvature in degree per 100 feet of an Optimized Geometric Hermite Curve path following response.
Figure 5:
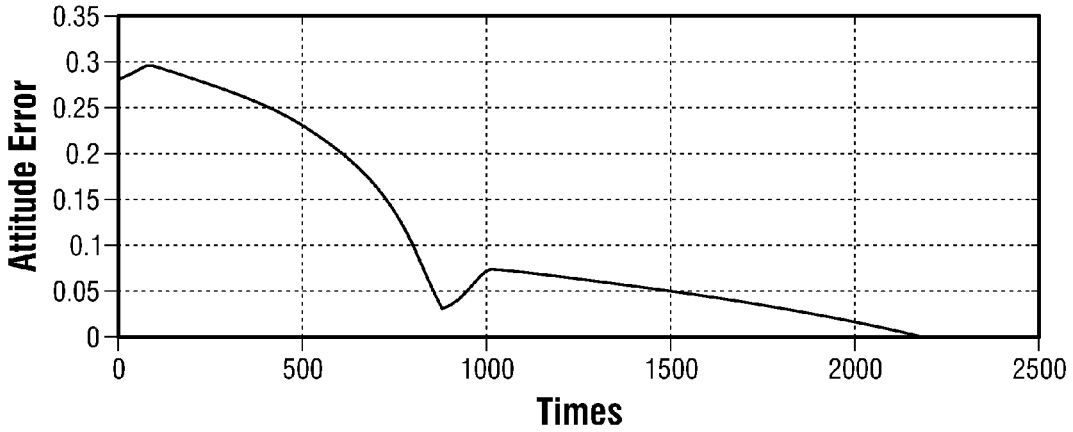
FIG. 5 is a graph of attitude error vs. time to a nearest target value.
Figure 6:
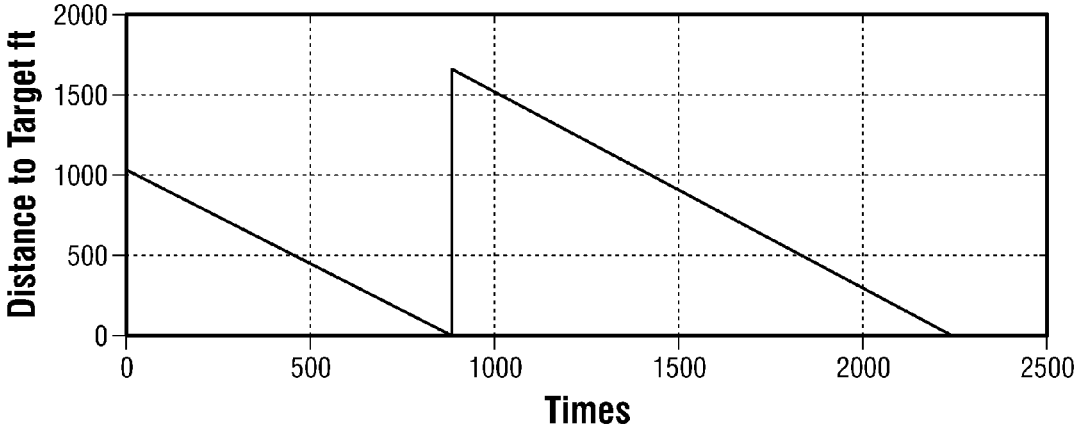
FIG. 6 is a simulated magnitude of distance from the tool to the nearest target.

The value of the tool attitude error can be seen to diminish towards any given target waypoint as can be seen from FIG. 5. For the intermediate waypoint, however, it does not diminish entirely. The reason for this is explained in FIG. 4, where the curvature of the path shortly before reaching the first target is seen to saturate to the constrained maximum curvature of 15°/100 ft as the tool nears the target.

To demonstrate the use of OGH curves for reaching and following a well path plan in the pay zone that has been defined, a transient simulation was run using Equation 1 and Equation 2 as the plant model, the operating point parameters listed in Table II and the path following architecture shown in FIG. 1. The kick off point for the simulation was deliberately set to be at an arbitrary attitude and position before the start point of the a priori path. The a priori path was generated from a separately run simulation in which the tools $K_{dls}$ was set to 8°/100 ft and the tool steered open loop according to a well-plan of predefined $U_{tf}$ and $U_{dls}$ down-links (commands) indexed by MD.

Figure 7:
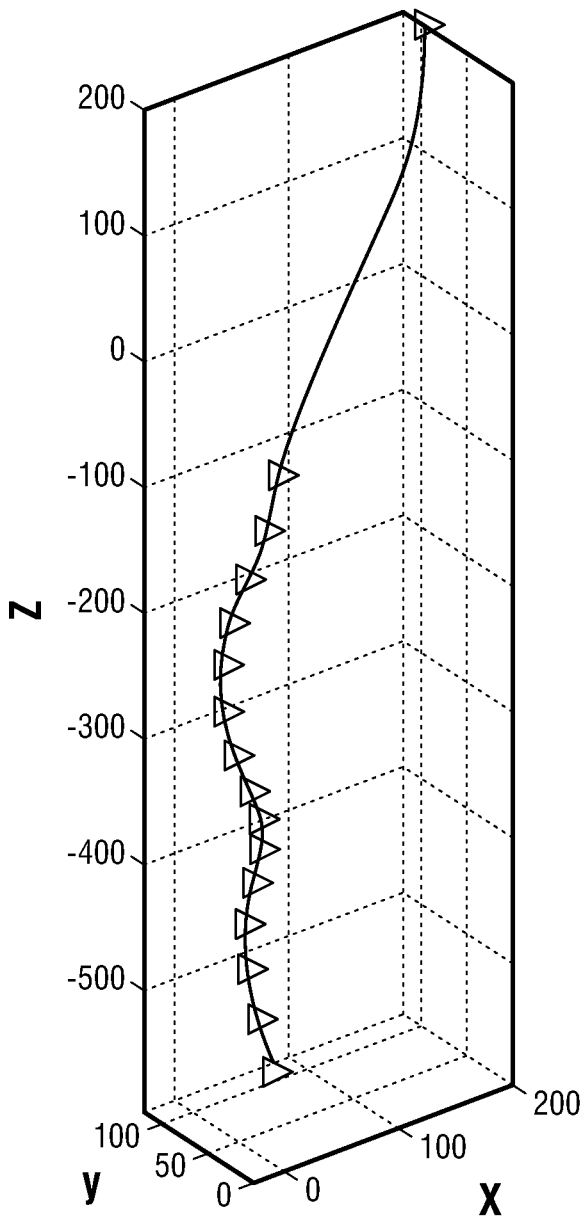
FIG. 7 is an Optimized Geometric Hermite Curve fit path following response.

FIG. 7 shows the trajectory response of the tool using the OGH curve algorithm. In FIG. 7, it can be seen that the tool not only successfully tracked the a priori path defined by a series of coarsely spaced waypoints, but also successfully reached the waypoints on the a priori path from the arbitrary kick off point.

TABLE II

TRANSIENT SIMULATION PARAMETERS

| Parameter | Value & Description |
|---|---|
| $V_{rop}$ | 50 ft/hr |
| $\Delta T$ | 90 s, drilling cycle period |
| $K_{dls}$ | 15°/100 ft tool capacity & 8°/100 ft well plan |
| $\omega_a$ | $2\pi/2.1 \times 10^4$ rad/s design $\theta_{azi}$ response natural frequency |
| $\omega_i$ | $2\pi/2.0 \times 10^4$ rad/s design $\theta_{inc}$ response natural frequency |
| $T_z$ | Fixed step ode3 Bogaki-Shampine solver, 200s step size. |

Figure 8A:
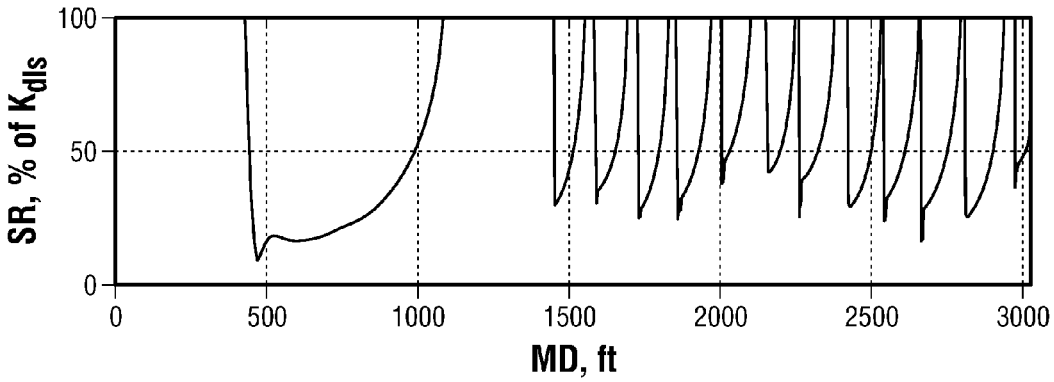
FIG. 8A is a graph of steering ratio vs. feet to waypoint.
Figure 8B:
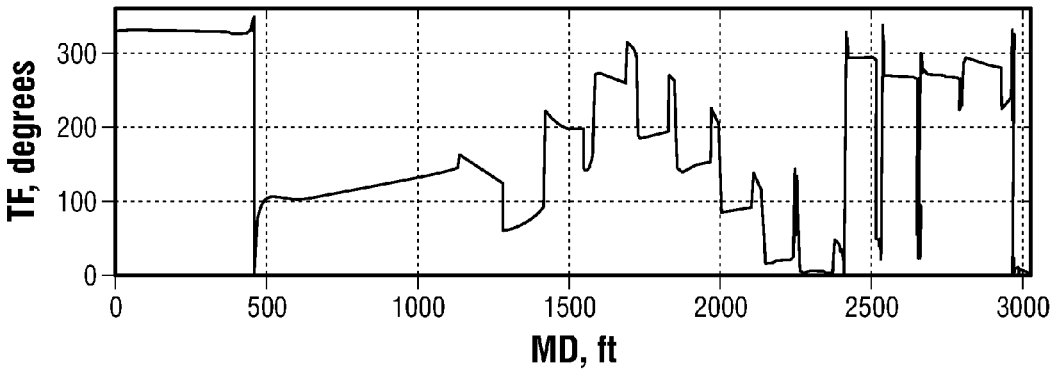
FIG. 8B is a graph of tool face degrees vs. feet to waypoint.
Figure 8C:
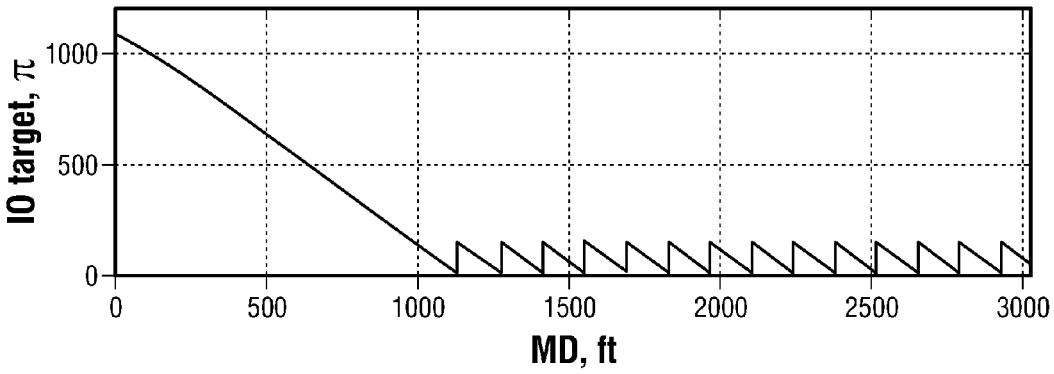
FIG. 8C is a graph of distance to waypoint as a function of depth.

FIG. 8 shows the control inputs, steering ratio and tool face required to follow the waypoints illustrated in FIG. 7. It can be seen from FIG. 8 that, in general, the steering ratio drops as the tool nears the waypoint before increasing to saturation (100%) when the algorithm switches to the next waypoint. Plot 3 in FIG. 8 shows the distance decreasing linearly between waypoints due to the constant $V_{rop}$.

In the embodiments described, OGH curves are used for online path planning to generate inclination and azimuth demand signals. The use of OGH space curves in this way enables a correction path in the form of a minimum strain energy cubic polynomial to be constructed between the instantaneous tool position and a succession of paypoints, each targeted in turn. The path-following architecture consists of an inner attitude-hold feedback loop and an outer loop to generate IAH attitude reference demands, as described in relation to FIG. 1. The OGH space curve fitting algorithm is implemented in the outer loop of the path-following architecture. By simulation, using this algorithm, the drill is shown to converge toward the waypoint position and attitude satisfactorily for typical drilling operating conditions.

The advantage of using OGH space curves in this application is that for the generation of a correction path, the resulting curve is described by a readily differentiable polynomial that enables evaluation of the strain energy applied as the drill-string is bent along the projected correction path. The minimal strain energy OGH correction-path curve fitted in this way therefore promotes the reduction of wellbore friction and hence it is anticipated will be beneficial for extended reach drilling. Additionally, simulation shows that the minimal strain energy OGH space curve fit approach is able to reach and follow a path defined by a sequence of waypoints.

Figure 9:
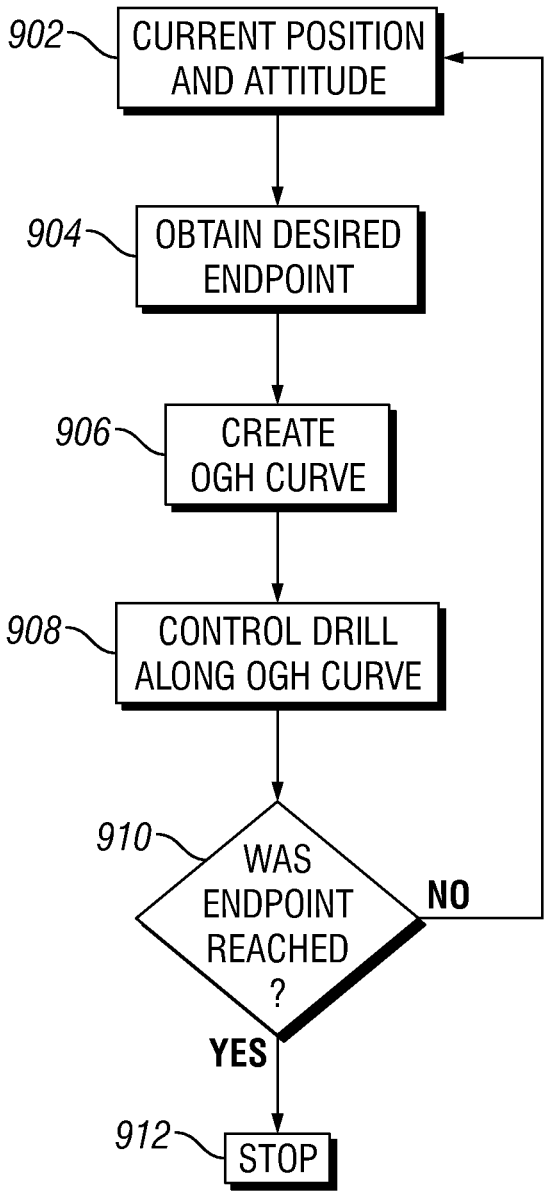
FIG. 9 is a flowchart of a method for controlling a drilling apparatus.

Referring to FIG. 9, a sample method 900 for controlling a drilling process is presented. In the illustrated embodiment, a current position and attitude of a bottom hole assembly is obtained 902. A desired endpoint 904 is provided by an operator. A cubic spiral spline curve is configured 906 between the current position and attitude obtained in step 902 and the desired end point 904. The drilling activities are controlled in step 908 through a plant model to track the created path provided in step 906. In the non-limiting embodiment, the plant model provided in Equations 1 and 2 and the following transformations are used in step 908.

In step 910, a query may be provided to determine if the desired endpoint has been reached. If the desired endpoint has been reached or is the tool measured to be within stopping distance of the target, the method may stop in step 912 or the next target may be chosen. Such stopping may entail stopping of further drilling. Such termination may be automatic or an alert may be provided to an operator that the end point has been reached. If the desired endpoint has not been reached, a feedback may be accomplished to step 902 and the method may continue. As will be understood, the curve developed may also be used to maximize a path along a hydrocarbon stratum to maximize chances for hydrocarbon recovery. The method and apparatus may be achieved such that any type of optimized spline may be used.

In one embodiment, a method of controlling drilling is provided comprising: ascertaining a current position and attitude of a drilling structure, obtaining a desired end point for the drilling structure, creating an optimized geometric hermite curve path for the drilling structure from the current position and attitude of the drilling structure to the desired end point for the drilling structure and controlling a drilling of the drilling structure from the current position and attitude of the drilling structure to the desired end point for the drilling structure along the optimized geometric hermite curve path. As will be understood, in a non-limiting embodiment, the drilling structure may be a drill string and/or a specific component in a drill string such as a drill bit. Obtaining a desired end point for the drilling structure may by through query of an operator or through a preplanned map determined before The method may further comprise checking the current position and attitude of the drilling structure to determine when the desired end point for the drilling structure is reached.

In a further method, the method may further comprise stopping the drilling of the drilling structure when the desired end point for the drilling structure is reached.

In a further method, the method may further comprise checking the current position of the drilling structure to determine when the desired end point for the drilling structure is reached.

In a further method, the method may further comprise checking the attitude of the drilling structure to determine when the desired end point for the drilling structure is reached.

In a further embodiment, an apparatus is presented comprising an arrangement configured to obtain a reference trajectory of a drilling apparatus, an arrangement configured to produce an optimized geometric hermite curve from a reference trajectory to a desired end point for the drilling apparatus, a kinematic plant modeling arrangement and an inclination and azimuth hold arrangement configured to control a drill bit of a drilling structure during drilling.

In a further embodiment, an apparatus is presented further comprising a spherical to Cartesian coordinate arrangement configured to obtain data from the kinematic plant model and convert the data from a spherical coordinate system to a Cartesian coordinate system.

In a further embodiment, the apparatus may further comprise a feedback loop configured to provide information on a measured attitude obtained from the kinematic plant model to the inclination azimuth hold arrangement.

The apparatus may further comprise a second feedback loop to provide data on a measured position and measured attitude from the spherical to Cartesian coordinate arrangement and provide the data to the arrangement configured to provide a optimized geometric hermite curve for a planned drill path trajectory.

In an additional embodiment, the apparatus may be configured wherein the feedback loop is further configured with a sensor configured to obtain the information on the measured attitude.

In a further embodiment, the apparatus may be configured wherein the second feedback loop is configured with a sensor and a sampler, wherein the sensor and the sampler are configured to obtain data on a measured position and measured attitude. As presented, all methods may be incorporated into articles of manufacture to control apparatus as necessary through the methods presented. In the illustrated embodiments, the methodologies may be performed on a computer, as a non-limiting example for carrying out the instructions provided. In the illustrated embodiments, the method steps and information may be transformed such that the data is visually represented to a user for feedback. Methods and apparatus illustrated may be incorporated in drilling operations to facilitate drilling objectives as defined by an operator.

While aspects have been disclosed with respect to a limited number of embodiments, those skills in the art, having the benefit of this disclosure, will appreciate numerous modifications and variations therefrom. It is intended that the appended claims cover such modifications and variations as within the true spirit and scope of the invention.

What is claimed is:

1. A method for controlling drilling of a subterranean wellbore through a target waypoint at a prescribed attitude, the method comprising:

(a) processing (i) a demand inclination and a demand azimuth received from an outer loop controller and (ii) a measured attitude of the wellbore at an inner loop controller to recursively compute steering tool settings;

(b) applying the steering tool settings to a steering tool to control drilling of the wellbore;

(c) measuring an attitude of the wellbore while drilling in (b) and feeding back the measured attitude to (a);

(d) transforming the attitude measured in (c) to Cartesian coordinates to obtain a measured trajectory including a measured attitude and a measured position in Cartesian coordinates;

(e) feeding back the measured trajectory obtained in (d) to the outer loop controller;

(f) processing a reference trajectory including a reference attitude and a reference position in combination with the measured trajectory obtained in (d) at the outer loop controller to recursively compute an optimized geometric hermite curve path from the measured trajectory to the reference trajectory to generate the demand inclination and the demand azimuth processed in (a);

wherein an inner control loop including (a), (b), and (c) and an outer control loop including (d), (e), and (f) run concurrently while drilling.

2. The method according to claim 1, further comprising:

one of stopping the drilling in (d) when a desired end point position and attitude is reached and moving to a next target.

3. The method of claim 1, wherein the reference trajectory includes a sequence of waypoints in space, each waypoint including (i) a position which it is desired for the wellbore to penetrate and (ii) an attitude which it is desired for the wellbore to meet a tangent.

4. The method of claim 1, wherein the demand inclination and the demand azimuth are generated in (f) using the following mathematical equations:

$$\theta_{inc}^{d} = \arctan\left\{\frac{[(x_d' * j)^2 + (x_d' * k)^2]^{1/2}}{x_d' * i}\right\}$$

-continued $$\theta_{azi}^{d} = \arctan\left\{\frac{x_d' * k}{x_d' * j}\right\}$$

wherein $\theta_{inc}^{d}$ represents the demand inclination, $\theta_{azi}^{d}$ represents the demand azimuth, $x_d'$ represents a demand attitude from the optimized geometric hermite curve path, and i, j, and k represent unit vectors in the Cartesian coordinates.

5. The method of claim 1, wherein the steering tool settings comprise a toolface direction $\theta_{TF}$ and a dogleg severity $K_{DLS}$.

6. A method for controlling drilling of a subterranean wellbore through a target waypoint at a prescribed attitude, the method comprising:

(a) receiving a (i) reference trajectory including a reference attitude and a reference position and (ii) a measured trajectory including a measured attitude and a measured position in Cartesian coordinates at an outer loop controller;

(b) recursively processing the reference trajectory and the measured trajectory using the outer loop controller to compute an optimized geometric hermite curve path from the measured trajectory to the reference trajectory to generate a demand inclination and a demand azimuth;

(c) recursively processing (i) the demand inclination and the demand azimuth generated by the outer loop controller and (ii) a measured attitude at an inner loop controller to generate steering tool settings;

(d) applying the steering tool settings to a steering tool to control drilling of the wellbore;

(e) obtaining the measured attitude of the wellbore while drilling in (d) and feeding back the measured attitude to the inner loop controller at (c);

(f) transforming the measured attitude to obtain the measured trajectory; and (g) feeding back the measured trajectory obtained in (f) to the outer loop controller at (a);

wherein an inner control loop including (c), (d), and (e) and an outer control loop including (a), (b), (f), and (g) run concurrently while drilling.

7. The method of claim 6, wherein the reference trajectory includes a sequence of waypoints in space, each waypoint including (i) a position which it is desired for the wellbore to penetrate and (ii) an attitude which it is desired for the wellbore to meet a tangent.

8. The method of claim 6, wherein the demand inclination and the demand azimuth are generated in (b) using the following mathematical equations:

$$\theta_{inc}^{d} = \arctan\left\{\frac{[(x_d' * j)^2 + (x_d' * k)^2]^{1/2}}{x_d' * i}\right\}$$

$$\theta_{azi}^{d} = \arctan\left\{\frac{x_d' * k}{x_d' * j}\right\}$$

wherein $\theta_{inc}^{d}$ represents the demand inclination, $\theta_{azi}^{d}$ represents the demand azimuth, $x_d'$ represents a demand attitude from the optimized geometric hermite curve path, and i, j, and k represent unit vectors in the Cartesian coordinates.

9. The method of claim 6, wherein the steering tool settings comprise a toolface direction $\theta_{TF}$ and a dogleg severity $K_{DLS}$.

10. A system for controlling a direction of drilling of a subterranean wellbore, the system comprising:

an outer loop controller deployed in an outer control loop configured to process a reference trajectory including a reference position and a reference attitude and a measured trajectory including a measured position and a measured attitude to recursively compute an optimized geometric hermite curve path from the measured trajectory to the reference trajectory to generate a demand inclination and a demand azimuth;

an inner loop controller deployed in an inner control loop configured to process the demand inclination and the demand azimuth generated by the outer loop controller and a measured attitude to generate steering tool settings;

a steering tool to apply the steering tool settings and to steer the drilling of the subterranean wellbore;

an attitude sensor configured to measure the measured attitude and to feedback the measured attitude to the inner loop controller; and a processing arrangement configured to transform the measured attitude to the measured trajectory and to feedback the measured trajectory to the outer loop controller;

wherein the inner control loop and the outer control loop are configured to run concurrently while drilling.

* * * * *